US008521401B2

(12) United States Patent
Hengl-Betz et al.

(10) Patent No.: US 8,521,401 B2
(45) Date of Patent: Aug. 27, 2013

(54) METHOD AND CONTROL UNIT FOR ELECTRIC CONTROL OF AN ACTUATOR OF AN INJECTION VALVE

(75) Inventors: Klaus Hengl-Betz, Regensburg-Schwabelweis (DE); Ulrike Klauk, Pettendorf (DE); Manfred Klepatsch, Pettendorf (DE)

(73) Assignee: Continental Automotive GmbH, Hannover (DE)

( * ) Notice: Subject to any disclaimer, the term of this patent is extended or adjusted under 35 U.S.C. 154(b) by 620 days.

(21) Appl. No.: 12/747,921

(22) PCT Filed: Oct. 14, 2008

(86) PCT No.: PCT/EP2008/063808

§ 371 (c)(1),
(2), (4) Date: Aug. 25, 2010

(87) PCT Pub. No.: WO2009/074375

PCT Pub. Date: Jun. 18, 2009

(65) Prior Publication Data

US 2010/0307456 A1 Dec. 9, 2010

(30) Foreign Application Priority Data

Dec. 13, 2007 (DE) ..... 10 2007 060 018

(51) Int. Cl.
*F02D 41/20* (2006.01)
*F02D 41/14* (2006.01)
*F02M 51/00* (2006.01)

(52) U.S. Cl.
USPC ..... 701/104

(58) Field of Classification Search
USPC ..... 701/104, 103, 105, 102; 123/478, 123/480, 472; 700/282
See application file for complete search history.

(56) References Cited

U.S. PATENT DOCUMENTS 7,421,332 B2 9/2008 Schurz et al. ..... 701/105
7,693,644 B2 4/2010 Aliakbarzadeh et al. ..... 701/105

(Continued)

FOREIGN PATENT DOCUMENTS

DE 3926031 C1 11/1990
DE 19930309 1/2001

(Continued)

OTHER PUBLICATIONS

International Search Report and Written Opinion for Application No. PCT/EP2008/063808 (12 pages), Feb. 11, 2009.

(Continued)

*Primary Examiner* — Hieu T Vo
(74) *Attorney, Agent, or Firm* — King & Spalding L.L.P.

(57) ABSTRACT

A method for the electric control of an actuator of an injection valve in an injection facility for an internal combustion engine has the following steps: specifying a target value for a controlled variable (E) of the actuator, pilot controlling the controlled variable (E) according to a pilot control characteristic that is specified by an axis section (OffsCal, Offs-Real) and a characteristic gradient, wherein as part of the pilot control corresponding to the specified target value according to the pilot control characteristic a control variable for the electric control of the actuator is determined, and readjustment of the pilot control characteristic, wherein a control deviation (ΔE) is ascertained as part of the readjustment and the pilot control characteristic is adapted as a function of the control deviation (ΔE). It is proposed that as part of the readjustment the axis section of the pilot control characteristic is set.

23 Claims, 4 Drawing Sheets

(56) References Cited

U.S. PATENT DOCUMENTS

| | | | | |
|---|---|---|---|---|
| 8,091,529 | B2 * | 1/2012 | Forster et al. | 700/282 |
| 8,280,611 | B2 * | 10/2012 | Forster et al. | 701/103 |
| 2008/0281503 | A1 | 11/2008 | Aliakbarzadeh et al. | 701/105 |
| 2012/0239275 | A1 * | 9/2012 | Hoshi et al. | 701/103 |

FOREIGN PATENT DOCUMENTS

| | | |
|---|---|---|
| DE | 10311540 | 1/2004 |
| DE | 10311011 A1 | 9/2004 |
| DE | 10340975 | 3/2005 |
| DE | 102005010028 | 9/2006 |
| EP | 1138909 | 10/2001 |
| WO | 2005066478 | 7/2005 |

OTHER PUBLICATIONS

German Office Action, German Patent Application No. 10 2007 060 018.8-26, 2 pages, Jun. 4, 2008.

* cited by examiner

METHOD AND CONTROL UNIT FOR ELECTRIC CONTROL OF AN ACTUATOR OF AN INJECTION VALVE

CROSS-REFERENCE TO RELATED APPLICATIONS

This application is a U.S. National Stage Application of International Application No. PCT/EP2008/063808 filed Oct. 14, 2008, which designates the United States of America, and claims priority to German Application No. 10 2007 060 018.8 filed Dec. 13, 2007, the contents of which are hereby incorporated by reference in their entirety.

TECHNICAL FIELD

The invention relates to a method for electric control of an actuator of an injection valve in a fuel-injection system for an internal combustion engine.

The invention further relates to a corresponding control unit.

BACKGROUND

In modern injection systems for internal combustion engines of motor vehicle piezoactuators, which are electrically controlled and cause a corresponding displacement of an valve pin in the respective injection valve depending on the electrical energy stored within them, are used for mechanical actuation of the injection valves, with the stroke of the valve pin being a function of the electrical energy stored in the piezoactuator.

The piezoactuators are usually electrically activated by a pilot control with an overlaid regulation. In such cases the desired electrical energy of the piezoactuator and thereby the desired stroke of the valve pin are predetermined as a target value. The pilot control then determines in accordance with a predetermined pilot control characteristic a corresponding control variable such as for example the pulse duty ratio for a pulse width modulated activation of a final stage. Adaptation of the pilot control characteristic as part of the overlaid regulation is also known from DE 10 2005 010 028 A1 by the characteristic gradient being adjusted within the framework of the regulation.

The disadvantage of the regulation in accordance with DE 10 2005 010 028 A1 is the fact that the modeled pilot control characteristic does not exactly match the real behavior of the system.

With a target value jump this leads to a control deviation initially occurring. This control deviation is actually regulated out by the regulator by the gradient of the pilot characteristic being adapted accordingly. During the adjustment time of the regulator however a dynamic control deviation occurs which is undesired.

SUMMARY

According to various embodiments, the known adjustment of the pilot control characteristic can be improved accordingly.

According to an embodiments, a method for electric activation of an actuator of an injection valve in a fuel injection system for an internal combustion engine, may comprise: a) Predetermining a target value for a controlled variable of the actuator, b) Pilot control of the controlled variable in accordance with a pilot control characteristic which is predetermined by an axis section and a characteristic gradient with, within the framework of the pilot control, in accordance with the predetermined target value in accordance with the pilot control characteristic a controlled variable being determined for electrical activation of the actuator, c) Readjustment of the pilot control characteristic with, within the framework of the readjustment a control deviation being determined and the pilot control characteristic being adapted as a function of the control deviation, wherein d) within the framework of the readjustment of the axis section the pilot control characteristic is set.

According to a further embodiment, a) the readjustment can be undertaken for a target value jump, b) for the target value jump the dynamic control deviation can be determined which occurs temporarily immediately after the target value jump before the regulating out, and c) the pilot control characteristic can be set as a function of the dynamic control deviation. According to a further embodiment, the adapted axis section of the pilot control characteristic can be calculated from the following variables: a) Target value of the controlled variable before the target value jump, b) Target value of the controlled variable after the target value jump, c) Actual value of the controlled variable immediately after the target value jump before the control deviation is regulated out, d) Control variable before the target value jump Control variable immediately after the target value jump before the control deviation is regulated out. According to a further embodiment, the adapted axis section of the pilot control characteristic can be calculated in accordance with the following formula:

$$OffsReal = OffsCal + \frac{E1_{TGT} \cdot \Delta E \cdot (PMW2 - PMW1)}{(E2_{TGT} - E1_{TGT}) \cdot (E2_{TGT} - E1_{TGT} + \Delta E)}$$

with

OffsReal: Adapted axis section of the pilot control characteristic after the readjustment, OffsCal: Non-adapted axis section of the pilot control characteristic before the readjustment, $E1_{TGT}$: Target value of the controlled variable before the target value jump, $E2_{TGT}$: Target value of the controlled variable after the target value jump, $E2_{ACT}$: Actual value of the controlled variable immediately after the target value jump before the control deviation is regulated out, $\Delta E$: $=E2_{ACT}-E2_{TGT}$, control deviation of the controlled variable immediately after the target value jump before the control deviation is regulated out, PWM1: Control variable before the target value jump, and/or PWM2: Control variable immediately after the target value jump before the control deviation is regulated out.

According to a further embodiment, within the framework of the readjustment, in addition to the axis section of the pilot control characteristic, the characteristic gradient of the pilot control characteristic can also be set. According to a further embodiment, the adapted characteristic gradient of the pilot control characteristic can be calculated as a function of the following variables: a) Control variable before the target value jump, b) Axis section of the pilot control characteristic before the target value jump, c) Adapted axis section of the pilot control characteristic after the target value jump, and/or d) Target value before the target value jump. According to a further embodiment, the adapted characteristic gradient of the pilot control characteristic can be calculated in accordance with the following formula:

$$K_{REAL} = \frac{PWM1 - OffsReal}{E1_{TGT}}$$

with $K_{REAL}$: Adapted characteristic gradient of the pilot control characteristic after the readjustment PWM1: Control variable before the target value jump, OffsReal: Adapted axis section of the pilot control characteristic after the readjustment, $E1_{TGT}$: Target value of the controlled variable before the target value jump.

According to a further embodiment, the method may further comprise: Pulse with modulated activation of the actuator by a final stage with a variable pulse duty ratio, with the pilot controlled and regulated controlled variable being the pulse duty ratio of the final stage. According to a further embodiment, the actuator can be a piezoactuator. According to a further embodiment, the controlled variable of the actuator can be the electrical energy stored in the actuator. According to a further embodiment, the pilot control characteristic can be readjusted during operation of the injection system only temporarily and/or individually. According to a further embodiment, a) for a target value jump the dynamic control deviation can be determined which occurs temporarily immediately after the target value jump before the regulating out, b) the dynamic control deviation can be compared with a predetermined maximum value the pilot control characteristic is only readjusted in the dynamic control deviation exceeds the maximum value. According to a further embodiment, a) In normal operation of the injection system ambient conditions can be checked to see whether they have changed, b) The pilot control characteristic may be only readjusted if the ambient conditions have changed. According to a further embodiment, the following ambient conditions can be checked to see whether they have changed: a) Temperature, especially ambient temperature, coolant temperature or oil temperature, b) State of ageing of the internal combustion engine, of the injection system and/or of the actuator, and/or c) Electrical capacitance of the actuator.

According to another embodiment, a control unit for electric activation of an actuator of an injection valve in an injection system for an internal combustion engine, may comprise: a) A pilot control which sets a controlled variable of the actuator in accordance with a predetermined target value in accordance with a pilot control characteristic, with the pilot control characteristic being defined by an axis section and a characteristic gradient, and b) A regulator which determines a control deviation of the controlled variable and readjusts the pilot control characteristic as a function of the control deviation, wherein c) the regulator, within the framework of the readjustment, sets the axis section of the pilot control characteristic.

According to a further embodiment of the control unit, a) The regulator may readjust the axis section and/or the characteristic gradient of the pilot control characteristic for a target value jump, b) The regulator may determine a dynamic control deviation for the target value jump which occurs temporarily immediately after the target value jump before the regulating out, and c) The regulator may set the pilot control characteristic as a function of the dynamic control deviation. According to a further embodiment of the control unit, the regulator may calculate the adapted axis section of the pilot control characteristic from the following variables: a) Target value of the controlled variable before the target value jump, b) Target value of the controlled variable after the target value jump, c) Actual value of the controlled variable immediately after the target value jump before the control deviation is regulated out, d) Controlled variable before the target value jump, e) Controlled variable immediately after the target value jump before the control deviation is regulated out. According to a further embodiment of the control unit, the regulator may calculate the adapted axis section of the pilot control characteristic in accordance with the following formula:

$$OffsReal = OffsCal + \frac{E1_{TGT} \cdot \Delta E \cdot (PMW2 - PMW1)}{(E2_{TGT} - E1_{TGT}) \cdot (E2_{TGT} - E1_{TGT} + \Delta E)}$$

with

OffsReal: Adapted axis section of the pilot control characteristic after the readjustment, OffsCal: Non-adapted axis section of the pilot control characteristic before the readjustment, $E1_{TGT}$: Target value of the controlled variable before the target value jump, $E2_{TGT}$: Target value of the controlled variable after the target value jump, $E2_{ACT}$: Actual value of the controlled variable directly after the target value jump before the control deviation is regulated out, $\Delta E$: $=E2_{ACT}-E2_{TGT}$, control deviation of the controlled variable immediately after the target value jump before the control deviation is regulated out, PWM1: Control variable before the target value jump, and/or PWM2: Control variable immediately after the target value jump before the control deviation is regulated out.

According to a further embodiment of the control unit, the regulator, within the framework of the readjustment, in addition to the axis section of the pilot control characteristic, also may set the gradient of the pilot control characteristic. According to a further embodiment of the control unit, the regulator may calculate the adapted characteristic gradient of the pilot control characteristic as a function of the following variables: a) Control variable before the target value jump, b) Axis section of the pilot control characteristic before the target value jump, c) Adapted axis section of the pilot control characteristic after the target value jump, and/or d) Target value before the target value jump. According to a further embodiment of the control unit, the controller may calculate the adapted characteristic gradient of the pilot control characteristic in accordance with the following formula:

$$K = \frac{PWM1 - OffsReal}{E1_{TGT}}$$

with

K: Adapted characteristic gradient of the pilot control characteristic after the readjustment PWM1: Controlled variable before the target value jump, OffsReal: Adapted axis section of the pilot control characteristic after the readjustment, $E1_{TGT}$: Target value of the controlled variable before the target value jump.

According to a further embodiment of the control unit, a) The control unit may determine for a target value jump the dynamic control deviation which occurs temporarily immediately after the target value jump before the regulating out, b) The control unit compares the dynamic control deviation with a predetermined maximum value, c) The control unit readjusts the axis section of the pilot control characteristic only when the amount of dynamic control deviation exceeds the maximum value.

According to yet another embodiment, a motor vehicle may comprise a control unit as described above.

BRIEF DESCRIPTION OF THE DRAWINGS

Further embodiments are explained below together with the description of an exemplary embodiment with reference to the figures. The figures show.

DETAILED DESCRIPTION

Figure 1:
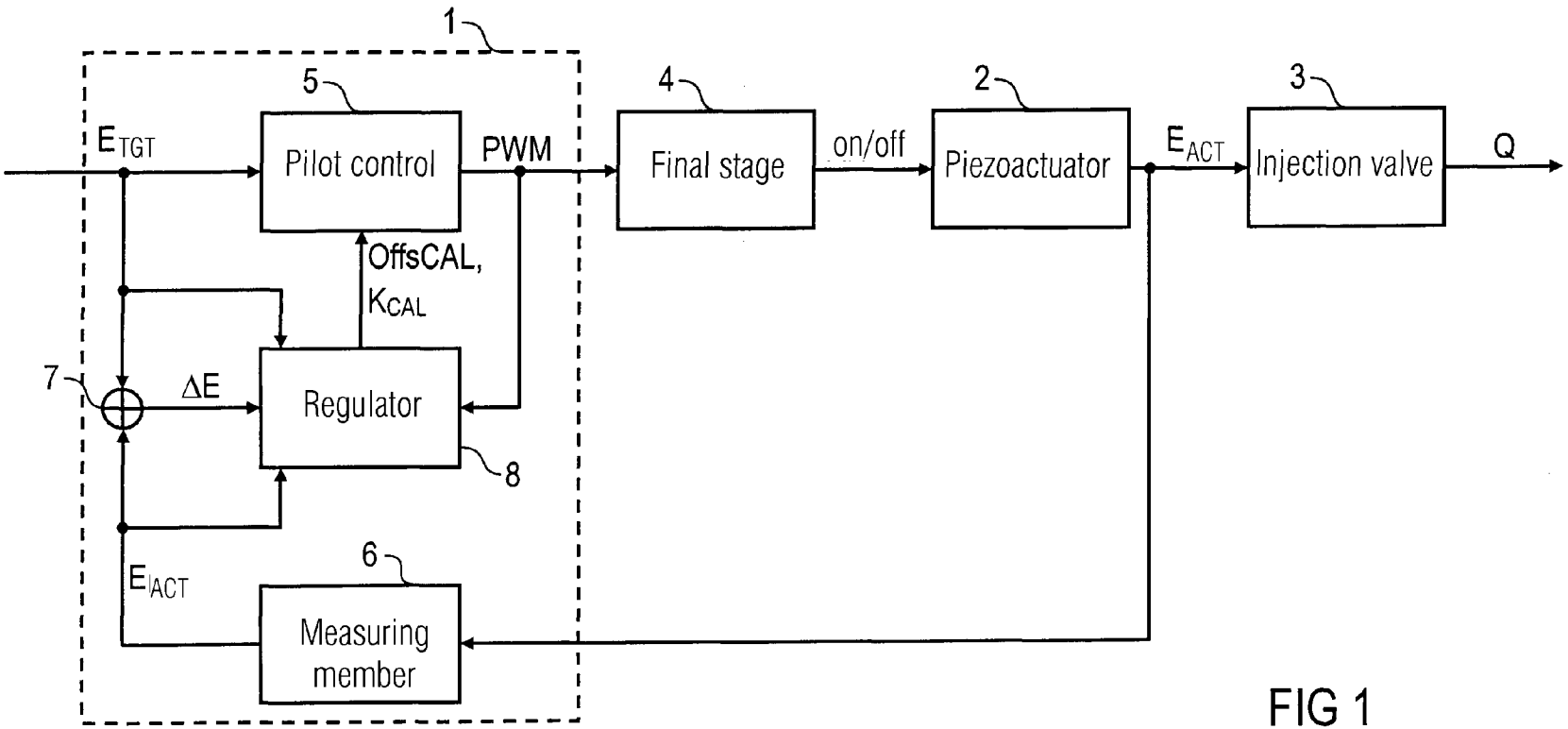
FIG. 1 a simplified diagram of a control unit for activating a piezoactuator according to an embodiment, FIG. 2 a modeled and a real pilot control characteristic for determining the pulse duty ratio of the pulse width modulated actuator activation as a function of the desired actuator energy, and also FIGS. 3A, 3B the method according to an embodiment in the form of a flow diagram.

According to various embodiments, not only readjusting the characteristic gradient during the correction of the pilot control characteristic but of adapting the axis section of the pilot characteristic in order to adapt the pilot characteristic as precisely as possible to the actual system behavior is provided.

Preferably the pilot characteristic is corrected during a target value jump, with the dynamic control deviation which occurs temporarily directly after the control value jump before the regulating out being determined. The pilot control characteristic is then set as a function of the dynamic control deviation. This idea is based on the knowledge that the dynamic control deviation for a target value jump is caused by the pilot control characteristic not correctly reflecting the actual system behavior.

In the calculation of the adapted axis section of the pilot control characteristic the following variables are preferably taken into account:

- Target value of the controlled variable (e.g. actuator energy) before the target value jump,
- Target value of the controlled variable after the target value jump,
- Actual value of the controlled variable directly after the target value jump before the control deviation is regulated out,
- Control or adjustment variable (e.g. pulse duty ratio of the pulse width modulated activation of the final stage) before the target value jump,
- Control or adjustment variable after the target value jump before the control deviation is regulated out.

The adapted axis section is preferably calculated here in accordance with the following formula:

$$OffsReal = OffsCal + \frac{E1_{TGT} \cdot \Delta E \cdot (PMW2 - PMW1)}{(E2_{TGT} - E1_{TGT}) \cdot (E2_{TGT} - E1_{TGT} + \Delta E)}$$

with:

OffsReal: Adapted axis section of the pilot control characteristic after the readjustment, OffsCal: Non-adapted axis section of the pilot control characteristic before the readjustment, $E1_{TGT}$: Target value of the controlled variable before the target value jump, $E2_{TGT}$: Target value of the controlled variable after the target value jump, $E2_{ACT}$: Actual value of the controlled variable immediately after the target value jump before the control deviation is regulated out, $\Delta E$: $=E2_{ACT}-E2_{TGT}$, control deviation of the controlled variable immediately after the target value jump before the control deviation is regulated out, PWM1: Control or adjustment variable before the target value jump, and/or PWM2: Control or adjustment variable immediately after the target value jump before the control deviation is regulated out.

In an embodiment, as part of the readjustment, not only the axis section of the pilot control characteristic is set, but also the characteristic gradient of the pilot control characteristic.

In the readjustment of the characteristic gradient of the pilot control characteristic the following variables are preferably taken into account:

- Control or adjustment variable before the target value jump,
- Axis section of the pilot control characteristic before the target value jump,
- Adapted axis section of the pilot control characteristic after the target value jump,
- Target value before the target value jump.

The adapted characteristic gradient of the pilot control characteristic is preferably calculated here in accordance with the following formula:

$$K_{REAL} = \frac{PWM1 - OffsReal}{E1_{TGT}}$$

with:

$K_{REAL}$: adapted characteristic gradient of the pilot control characteristic after the readjustment PWM1: Control or adjustment variable before the target value jump, OffsReal: Adapted axis section of the pilot control characteristic after the readjustment, $E1_{TGT}$: Target value of the controlled variable (E) before the target value jump.

The actuator is preferably actuated pulse-width modulated by the final stage with a variable pulse duty ratio, with the controlled variable controlled and readjusted according to various embodiments being the pulse duty ratio of the final stage. The invention is not however restricted to a pulse-width modulated activation in respect of the electrical activation of the actuator, but is basically also able to be realized with other activation methods.

Furthermore the actuator according to various embodiments basically involves a piezoactuator. The invention is not however restricted to piezoactuators in respect of the actuator type, but is basically able to be realized with other types of actuator.

It has already been stated above that the controlled variable of the actuator is preferably the electrical energy stored in the actuator, which for piezoactuators determines the stroke of the valve pin of the injection valve. The invention is however not restricted to energy stored in the actuator in respect of the controlled variable. For example other controlled variables can also determine the stroke of the valve pin with other actuator types.

In the exemplary embodiment the readjustment of the pilot control characteristic does not occur continuously but only on demand, i.e. if the pilot control characteristic no longer reflects the actual system behavior sufficiently accurately.

The pilot control characteristic is therefore readjusted during operation of the injection system preferably only temporarily and/or only individually.

With a demand-controlled readjustment of the pilot control characteristic the need for control can be recognized from the fact that the dynamic control deviation occurring during a target value jump exceeds a predetermined maximum value as regards its amount. The axis section of the pilot control characteristic is therefore readjusted only if the dynamic control deviation occurring for a target value jump exceeds the predetermined maximum value.

In another embodiment on the other hand the ambient conditions of the injection system are checked to see whether they have changed, with the pilot control characteristic only being readjusted if the ambient conditions have changed to a specific extent. For example the temperature, especially the ambient temperature, the coolant temperature or the oil temperature, can be checked here. Furthermore the state of the ageing of the internal combustion engine, of the injection system and/or of the actuator can be checked in order to undertake a readjustment of the pilot control characteristic at specific intervals. Finally the electrical capacitance of the actuator can be monitored so that the pilot characteristic can be readjusted if there is a change in capacitance.

As well as the method according to various embodiments described here the invention also includes a corresponding control unit which executes the method.

Finally the invention also includes a motor vehicle with such a control unit which executes the method.

FIG. 1 shows a simplified schematic diagram of a control unit 1 for activating a piezoactuator 2 according to various embodiments, with the piezoactuator 2 in the conventional manner actuating an injection valve 3 for an internal combustion engine of a motor vehicle.

The input side of the control unit 1 in this case receives from an electronic engine control unit (ECU: Electronic Control Unit) target values $E_{TGT}$ for the actuator energy stored in the piezoactuator 2, since the actuator energy E determines the stroke of the valve pin of the injection valve 3 and thereby a fuel volume quantity Q.

The piezoactuator 2 is activated in the conventional manner pulse width modulated by a final stage 4 with a variable pulse width modulation PWM.

The pulse width modulation PWM is determined in this case by a pilot control 5 in accordance with a pilot control characteristic as a function of the desired target value $E_{TGT}$.

In addition the control unit 1 has a measuring member 6, which measures an actual value $E_{ACT}$ of the actuator energy E to enable the pilot control characteristic to be readjusted.

The actual value $E_{ACT}$ is therefore fed to a subtractor 7 which computes from the predetermined target value $E_{TGT}$ and the measured actual value $E_{ACT}$ of the actuator energy E a control deviation ΔE which is fed to a regulator 8.

The regulator 8 can readjust the pilot control characteristic used by the pilot control 5 should this be necessary. A readjustment of the pilot control characteristic is required for example if the pilot control characteristic modeled and used by the pilot control 5 does not adequately reflect the actual system behavior, which for a target value jump leads to a large dynamic control deviation ΔE.

In the readjustment of the pilot control characteristic the regulator 8 adjusts both the axis section OffsCal and also a characteristic gradient $K_{CAL}$, as will be described in detail below.

The pilot control characteristic is not readjusted permanently however at the control unit 1, but only as required, if the modeled pilot control characteristic does not adequately reflect the actual system behavior any longer. This can be recognized from the fact that the dynamic control deviation ΔE for a target value jump exceeds a predetermined maximum value $\Delta E_{MAX}$.

Figure 2:
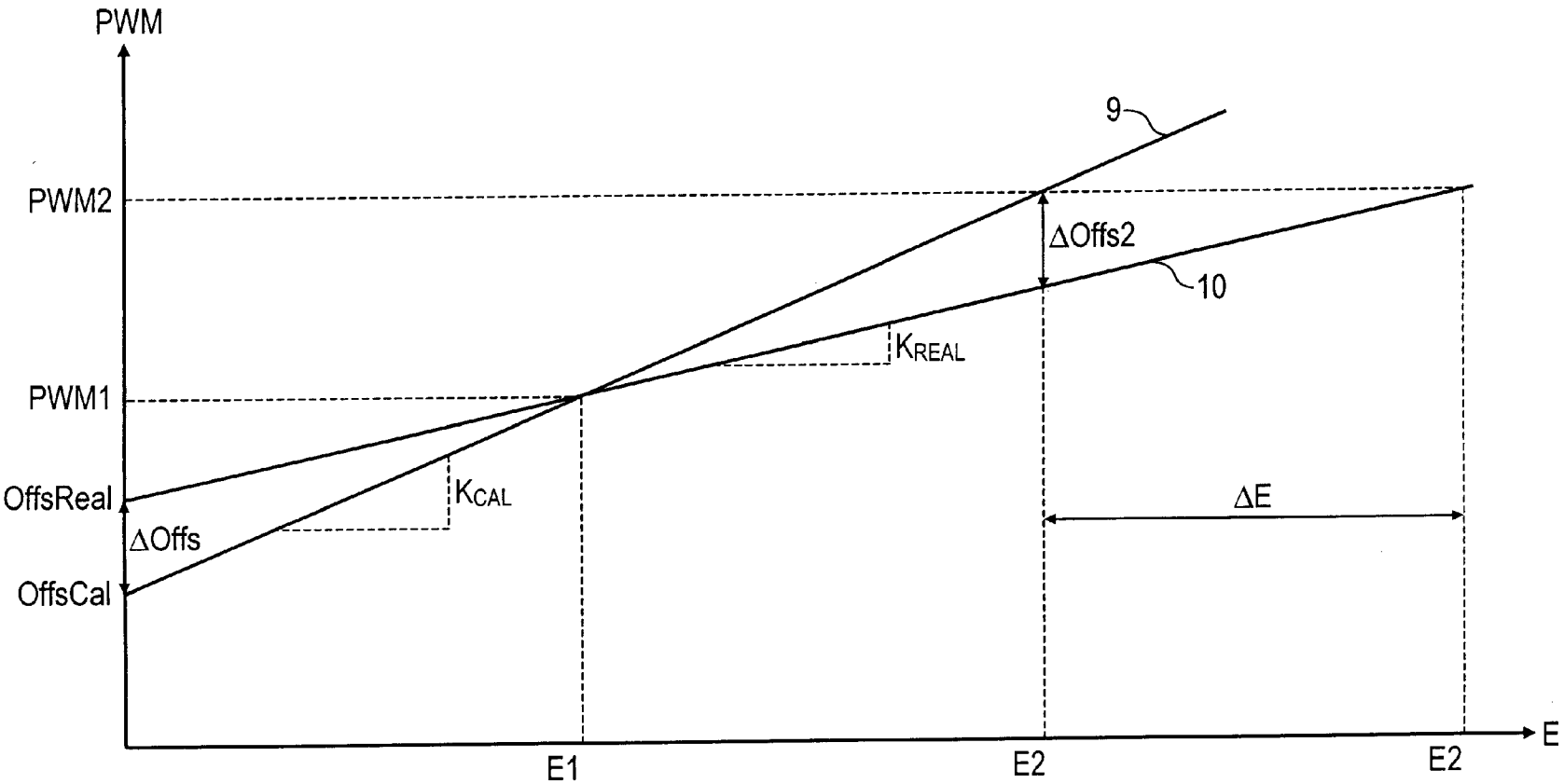

These significant parameters of variables of the pilot control will now be explained below with reference to the diagram in FIG. 2.

The diagram thus shows a modeled pilot characteristic 9 which is defined by an axis section OffsCal and a characteristic gradient $K_{CAL}$.

The diagram also shows a real pilot characteristic 10, which is defined by an axis section OffsReal and a characteristic gradient $K_{REAL}$ and which reflects the actual dependency of the pulse width modulation PWM on the resulting actuator energy E.

The deviation between the modeled pilot characteristic 9 and the real pilot control characteristic 10, with a target value jump from a first target value $E1_{TGT}$ to a second target value $E2_{TGT}$, leads to a dynamic control deviation ΔE.

Figure 3A:
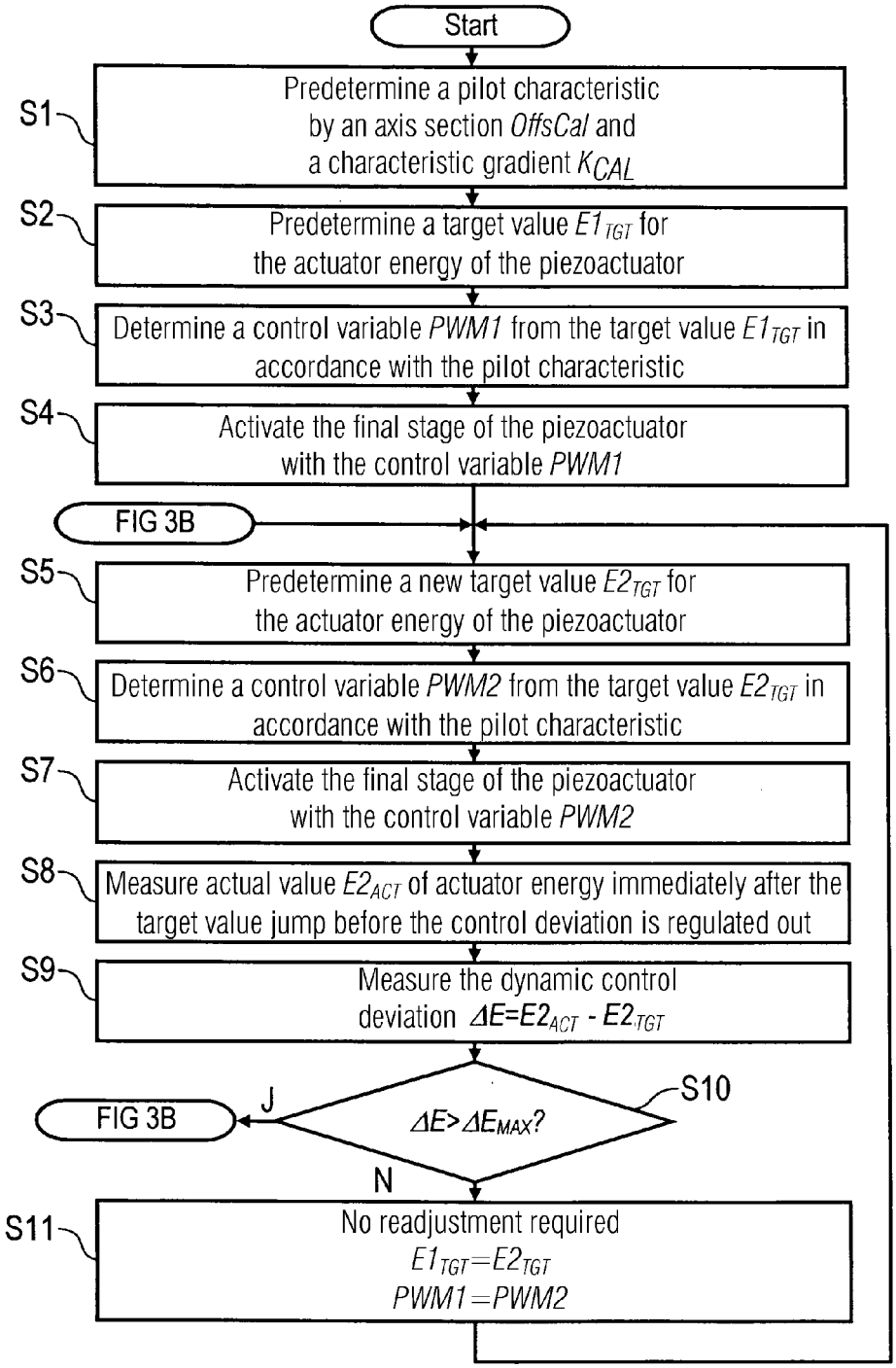

The method according to various embodiments will now be described below with reference to the flow diagram shown in FIGS. 3A and 3B.

In a first step S1 the modeled pilot control characteristic 9 is initially predetermined by the axis section OffsCal and the characteristic gradient $K_{CAL}$ being defined.

In a second step S2 a first target value $E1_{TGT}$ is then predetermined for the actuator energy E of the piezoactuator 2.

In a step S3 a pulse width modulation PWM1 is then determined in accordance with the modeled pilot control characteristic 9 from the predetermined target value $E1_{TGT}$.

The final stage 4 for the piezoactuator 2 is then activated in a step S4 with this pulse width modulation PWM1.

In a step S5 a new target value $E2_{TGT}$ for the actuator energy of the piezoactuator 2 is then predetermined, which leads to a target value jump.

In a step S6, in accordance with the modeled pilot characteristic 9, a corresponding pulse width modulation PWM2 is then determined as a function of the new target value $E2_{TGT}$.

The final stage 4 is then activated with the new pulse width modulation PWM2 in a step S7.

In a step S8 the measuring member 6 then measures the actual value $E2_{ACT}$ of the actuator energy immediately after the target value jump before the control deviation is regulated out.

The subtractor 7 then computes in a step S9 the control deviation $\Delta E = E2_{ACT} - E2_{TGT}$ In a further step S10 the regulator 8 then checks whether the dynamic control deviation ΔE exceeds a predetermined maximum value $\Delta E_{MAX}$. This is the case if the modeled pilot characteristic 9 does not sufficiently exactly match the real pilot characteristic 10.

If the dynamic control deviation ΔE occurring during the target value jump does not exceed the predetermined maximum value $\Delta E_{MAX}$, no readjustment of the modeled pilot characteristic 9 is required and the control unit accepts the new values in a step S11 and subsequently continues with step S5.

Figure 3B:
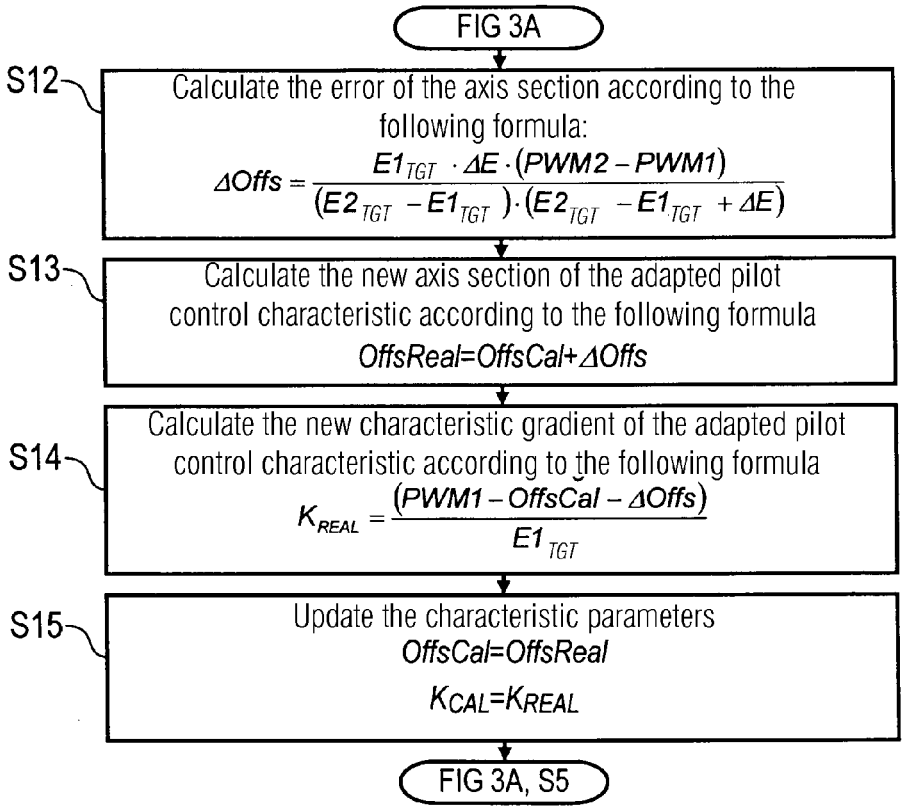

If on the other hand the dynamic control deviation ΔE occurring during a target value jump exceeds the predetermined maximum value $\Delta E_{MAX}$, the readjustment of the pilot control characteristic 9 depicted in FIG. 3B is undertaken.

To this end, in a step S12, the deviation ΔOffs between the axis section OffsReal of the real pilot control characteristic 10 and the axis section OffsCal of the modeled pilot control characteristic 9 is initially computed, with the error ΔOffs being produced, by applying the intercept theorem, from the following formula:

$$\Delta Offs = \frac{E1_{TGT} \cdot \Delta E(PWM2 - PWM1)}{(E2_{TGT} - E1_{TGT}) \cdot (E2_{TGT} - E1_{TGT}) + \Delta E}$$

with:

$E1_{TGT}$: Target value of the actuator energy E before the target value jump $E2_{TGT}$: Target value of the actuator energy E after the target value jump ΔE: Dynamic control deviation immediately after the target value jump PWM1: Pulse width modulation of the final stage before the target value jump PWM2: Pulse width modulation of the final stage after the target value jump.

In a subsequent step S13 the new axis section OffsReal of the adapted pilot control characteristic is then computed in accordance with the following formula:

OffsReal=OffsCal+ΔOffs.

In a step S14 the characteristic gradient of the pilot control characteristic is then also adapted in accordance with the following formula $$K_{REAL} = \frac{PWM1 - OffsCal - \Delta Offs}{E1_{TGT}}$$

with:

PWM1: Pulse width modulation before the target value jump

OffsCal: Axis section of the non-adapted pilot control characteristic 9

ΔOffs: Deviation between axis section OffsReal and the axis section OffsCal $E1_{TGT}$: Target value of the actuator energy E before the target value jump.

In a step S15 the characteristic parameters of the pilot control characteristic are then updated.

The invention not restricted to the exemplary embodiment described above. Instead a plurality of variants and derivatives are possible which likewise make use of the inventive idea and thus fall within the scope of protection.

What is claimed is:

1. A control unit for electric activation of an actuator of an injection valve in an injection system for an internal combustion engine, comprising:

a) A pilot control which sets a controlled variable of the actuator in accordance with a predetermined target value in accordance with a pilot control characteristic, with the pilot control characteristic being defined by an axis section and a characteristic gradient, and b) A regulator which determines a control deviation of the controlled variable and readjusts the pilot control characteristic as a function of the control deviation, c) wherein the regulator, within the framework of the readjustment, sets the axis section of the pilot control characteristic.

2. The control unit according to claim 1, wherein a) The regulator readjusts at least one of the axis section and the characteristic gradient of the pilot control characteristic for a target value jump, b) The regulator determines a dynamic control deviation for the target value jump which occurs temporarily immediately after the target value jump before the regulating out, and c) The regulator sets the pilot control characteristic as a function of the dynamic control deviation.

3. The control unit according to claim 2, wherein the regulator calculates the adapted axis section of the pilot control characteristic from the following variables:

a) Target value of the controlled variable before the target value jump, b) Target value of the controlled variable after the target value jump, c) Actual value of the controlled variable immediately after the target value jump before the control deviation is regulated out, d) Controlled variable before the target value jump, e) Controlled variable immediately after the target value jump before the control deviation is regulated out.

4. The control unit as claimed in claim 3, characterized in that the regulator calculates the adapted axis section of the pilot control characteristic in accordance with the following formula:

$$OffsReal = OffsCal + \frac{E1_{TGT} \cdot \Delta E \cdot (PMW2 - PMW1)}{(E2_{TGT} - E1_{TGT}) \cdot (E2_{TGT} - E1_{TGT} + \Delta E)}$$

with

OffsReal: Adapted axis section of the pilot control characteristic after the readjustment, OffsCal: Non-adapted axis section of the pilot control characteristic before the readjustment, $E1_{TGT}$: Target value of the controlled variable before the target value jump, $E2_{TGT}$: Target value of the controlled variable after the target value jump, $E2_{ACT}$: Actual value of the controlled variable directly after the target value jump before the control deviation is regulated out, ΔE: $=E2_{ACT}-E2_{TGT}$, control deviation of the controlled variable immediately after the target value jump before the control deviation is regulated out, PWM1: Control variable before the target value jump, and/or PWM2: Control variable immediately after the target value jump before the control deviation is regulated out.

5. The control unit according to claim 1, wherein the regulator, within the framework of the readjustment, in addition to the axis section of the pilot control characteristic, also sets the gradient of the pilot control characteristic.

6. The control unit according to claim 5, wherein the regulator calculates the adapted characteristic gradient of the pilot control characteristic as a function of at least one of the following variables:

a) Control variable before the target value jump, b) Axis section of the pilot control characteristic before the target value jump, c) Adapted axis section of the pilot control characteristic after the target value jump, and d) Target value before the target value jump.

7. The control unit according to claim 6, wherein the controller calculates the adapted characteristic gradient of the pilot control characteristic in accordance with the following formula:

$$K = \frac{PWM1 - OffsReal}{E1_{TGT}}$$

with

K: Adapted characteristic gradient of the pilot control characteristic after the readjustment PWM1: Controlled variable before the target value jump, OffsReal: Adapted axis section of the pilot control characteristic after the readjustment, $E1_{TGT}$: Target value of the controlled variable before the target value jump.

8. The control unit according to claim 1, wherein a) The control unit determines for a target value jump the dynamic control deviation which occurs temporarily immediately after the target value jump before the regulating out, b) The control unit compares the dynamic control deviation with a predetermined maximum value, c) The control unit readjusts the axis section of the pilot control characteristic only when the amount of dynamic control deviation exceeds the maximum value.

9. A motor vehicle with a control unit according to claim 1.

10. A method for electric activation of an actuator of an injection valve in a fuel injection system for an internal combustion engine, comprising:

a) Predetermining a target value for a controlled variable of the actuator, b) Pilot control of the controlled variable in accordance with a pilot control characteristic which is predetermined by an axis section and a characteristic gradient with, within the framework of the pilot control, in accordance with the predetermined target value in accordance with the pilot control characteristic a controlled variable being determined for electrical activation of the actuator, c) Readjustment of the pilot control characteristic with, within the framework of the readjustment a control deviation being determined and the pilot control characteristic being adapted as a function of the control deviation, d) wherein within the framework of the readjustment of the axis section the pilot control characteristic is set.

11. The method according to claim 10, wherein a) the readjustment is undertaken for a target value jump, b) for the target value jump the dynamic control deviation is determined which occurs temporarily immediately after the target value jump before the regulating out, and c) the pilot control characteristic is set as a function of the dynamic control deviation.

12. The method according to claim 11, wherein the adapted axis section of the pilot control characteristic is calculated from the following variables:

a) Target value of the controlled variable before the target value jump, b) Target value of the controlled variable after the target value jump, c) Actual value of the controlled variable immediately after the target value jump before the control deviation is regulated out, d) Control variable before the target value jump Control variable immediately after the target value jump before the control deviation is regulated out.

13. The method according to claim 12, wherein the adapted axis section of the pilot control characteristic is calculated in accordance with the following formula:

$$OffsReal = OffsCal + \frac{E1_{TGT} \cdot \Delta E \cdot (PMW2 - PMW1)}{(E2_{TGT} - E1_{TGT}) \cdot (E2_{TGT} - E1_{TGT} + \Delta E)}$$

with

OffsReal: Adapted axis section of the pilot control characteristic after the readjustment, OffsCal: Non-adapted axis section of the pilot control characteristic before the readjustment, $E1_{TGT}$: Target value of the controlled variable before the target value jump, $E2_{TGT}$: Target value of the controlled variable after the target value jump, $E2_{ACT}$: Actual value of the controlled variable immediately after the target value jump before the control deviation is regulated out, $\Delta E$: $=E2_{ACT}-E2_{TGT}$, control deviation of the controlled variable immediately after the target value jump before the control deviation is regulated out, PWM1: Control variable before the target value jump, and/or PWM2: Control variable immediately after the target value jump before the control deviation is regulated out.

14. The method according to claim 10, wherein, within the framework of the readjustment, in addition to the axis section of the pilot control characteristic, the characteristic gradient of the pilot control characteristic is also set.

15. The method according to claim 14, wherein the adapted characteristic gradient of the pilot control characteristic is calculated as a function of at least one of the following variables:

a) Control variable before the target value jump, b) Axis section of the pilot control characteristic before the target value jump, c) Adapted axis section of the pilot control characteristic after the target value jump, and d) Target value before the target value jump.

16. The method according to claim 15, wherein the adapted characteristic gradient of the pilot control characteristic is calculated in accordance with the following formula:

$$K_{REAL} = \frac{PWM1 - OffsReal}{E1_{TGT}}$$

with $K_{REAL}$: Adapted characteristic gradient of the pilot control characteristic after the readjustment PWM1: Control variable before the target value jump, OffsReal: Adapted axis section of the pilot control characteristic after the readjustment, $E1_{TGT}$: Target value of the controlled variable before the target value jump.

17. The method according to claim 10, comprising:

Pulse with modulated activation of the actuator by a final stage with a variable pulse duty ratio, with the pilot controlled and regulated controlled variable being the pulse duty ratio of the final stage.

18. The method according to claim 10, wherein the actuator is a piezoactuator.

19. The method according to claim 10, wherein the controlled variable of the actuator is the electrical energy stored in the actuator.

20. The method according to claim 10, wherein the pilot control characteristic is readjusted during operation of the injection system only temporarily and/or individually.

21. The method according to claim 10, wherein a) for a target value jump the dynamic control deviation is determined which occurs temporarily immediately after the target value jump before the regulating out, b) the dynamic control deviation is compared with a predetermined maximum value the pilot control characteristic is only readjusted in the dynamic control deviation exceeds the maximum value.

22. The method according to claim 21, wherein at least one of the following ambient conditions are checked to see whether they have changed:

a) Temperature, especially ambient temperature, coolant temperature or oil temperature, b) State of ageing of at least one of the internal combustion engine, of the injection system and of the actuator, and c) Electrical capacitance of the actuator.

23. The method according to claim 10, wherein a) In normal operation of the injection system ambient conditions are checked to see whether they have changed, b) The pilot control characteristic is only readjusted if the ambient conditions have changed.

* * * * *